US009115949B1

(12) United States Patent
Morrison

(10) Patent No.: US 9,115,949 B1
(45) Date of Patent: Aug. 25, 2015

(54) COIL-EQUIPPED FIREARM SUPPRESSOR

(71) Applicant: Robert Scott Morrison, Hoschton, GA (US)

(72) Inventor: Robert Scott Morrison, Hoschton, GA (US)

( * ) Notice: Subject to any disclaimer, the term of this patent is extended or adjusted under 35 U.S.C. 154(b) by 0 days.

(21) Appl. No.: 14/182,273

(22) Filed: Feb. 17, 2014

Related U.S. Application Data

(60) Provisional application No. 61/836,508, filed on Jun. 18, 2013, provisional application No. 61/872,012, filed on Aug. 30, 2013, provisional application No. 61/892,070, filed on Oct. 17, 2013, provisional application No. 61/892,087, filed on Oct. 17, 2013.

(51) Int. Cl.
*F41A 21/30* (2006.01)
*F41A 21/00* (2006.01)

(52) U.S. Cl.
CPC ..... *F41A 21/30* (2013.01)

(58) Field of Classification Search
USPC ..... 181/223; 89/14.4, 14.3, 14.2
See application file for complete search history.

(56) References Cited

U.S. PATENT DOCUMENTS

| | | | | | |
|---|---|---|---|---|---|
| 825,010 | A | * | 7/1906 | Snow | 181/264 |
| 1,017,003 | A | | 2/1912 | Kenney | |
| 1,111,202 | A | * | 9/1914 | Westfall | 89/14.4 |
| 1,127,250 | A | * | 2/1915 | Humm | 181/223 |
| 1,482,805 | A | | 2/1924 | Maxim | |
| 1,747,876 | A | * | 2/1930 | Metzgar | 181/264 |
| 1,860,276 | A | * | 5/1932 | De Luce et al. | 89/14.2 |
| 1,939,700 | A | * | 12/1933 | Hofstetter | 89/14.2 |
| 2,780,962 | A | * | 2/1957 | Ressler et al. | 89/14.2 |
| 2,792,760 | A | | 5/1957 | Hammer | |
| 3,385,164 | A | | 5/1968 | Walther et al. | |
| 4,291,610 | A | | 9/1981 | Waiser | |
| 4,530,417 | A | | 7/1985 | Daniel | |
| 4,576,083 | A | * | 3/1986 | Seberger, Jr. | 89/14.4 |
| 4,584,924 | A | | 4/1986 | Taguchi | |
| 4,588,043 | A | | 5/1986 | Finn | |
| 4,869,151 | A | | 9/1989 | Chahin | |
| 4,907,488 | A | | 3/1990 | Seberger, Jr. | |
| 4,974,489 | A | | 12/1990 | Fishbaugh | |
| 5,029,512 | A | | 7/1991 | Latka | |
| 5,092,223 | A | | 3/1992 | Hudson | |
| 5,136,923 | A | | 8/1992 | Walsh, Jr. | |
| 5,164,535 | A | | 11/1992 | Leasure | |
| 5,425,299 | A | | 6/1995 | Teetzel | |

(Continued)

FOREIGN PATENT DOCUMENTS

| | | | | |
|---|---|---|---|---|
| GB | 2281119 | A * | 2/1995 | F41A 21/30 |

OTHER PUBLICATIONS

U.S. Office Action dated Sep. 4, 2014 in U.S. Appl. No. 14/134,023.

(Continued)

*Primary Examiner* — Edgardo San Martin
(74) *Attorney, Agent, or Firm* — Hartman & Citrin LLC

(57) ABSTRACT

Embodiments of a coil-equipped firearm suppressor are disclosed herein. According to various embodiments, the coil-equipped firearm suppressor can include a firearm suppressor housing. The firearm suppressor housing can include an outer surface, an inner cavity, and an attachment mechanism that attaches the firearm suppressor housing to a barrel of a firearm. The inner cavity can accommodate a baffle insert. The baffle insert can include one or more removable coils and/or rods that can enhance the suppression capabilities of the coil-equipped firearm suppressor.

20 Claims, 7 Drawing Sheets

(56) References Cited

U.S. PATENT DOCUMENTS

| | | | | |
|---|---|---|---|---|
| 5,476,028 | A | 12/1995 | Seberger, Jr. | |
| 5,610,360 | A | 3/1997 | Kazyaka et al. | |
| 5,773,746 | A | 6/1998 | Vaden | |
| D415,812 | S | 10/1999 | Andrews, Jr. et al. | |
| D415,813 | S | 10/1999 | O'Quinn et al. | |
| D435,623 | S | 12/2000 | Andrews, Jr. et al. | |
| 6,302,009 | B1 | 10/2001 | O'Quinn et al. | |
| 6,308,609 | B1 | 10/2001 | Davies | |
| 6,374,718 | B1 | 4/2002 | Rescigno et al. | |
| 6,575,074 | B1 | 6/2003 | Gaddini | |
| 7,073,426 | B1 | 7/2006 | White | |
| 7,194,836 | B1 | 3/2007 | Urban | |
| 7,325,474 | B2 | 2/2008 | Yoshimura et al. | |
| D594,082 | S | 6/2009 | O'Quinn | |
| 7,588,122 | B2 * | 9/2009 | Brittingham | 181/223 |
| 7,854,085 | B1 | 12/2010 | Hodgkins et al. | |
| 7,905,171 | B1 | 3/2011 | Brittingham | |
| 8,087,338 | B1 * | 1/2012 | Hines | 89/14.4 |
| 8,096,222 | B2 | 1/2012 | Silvers | |
| 8,162,100 | B2 | 4/2012 | Shults et al. | |
| 8,167,084 | B1 | 5/2012 | Moore | |
| 8,439,155 | B2 | 5/2013 | Shults et al. | |
| 8,479,632 | B2 | 7/2013 | Kline et al. | |
| 8,479,878 | B2 | 7/2013 | Schlosser | |
| 8,561,757 | B1 * | 10/2013 | Edsall | 181/223 |
| 8,978,818 | B2 * | 3/2015 | Proske | 181/223 |
| 2007/0107590 | A1 | 5/2007 | Silvers | |
| 2010/0126334 | A1 | 5/2010 | Shults et al. | |
| 2011/0067950 | A1 | 3/2011 | Shults et al. | |
| 2012/0255807 | A1 * | 10/2012 | Pieratti | 181/223 |

OTHER PUBLICATIONS

U.S. Office Action dated Oct. 28, 2014 in U.S. Appl. No. 14/134,044.

* cited by examiner

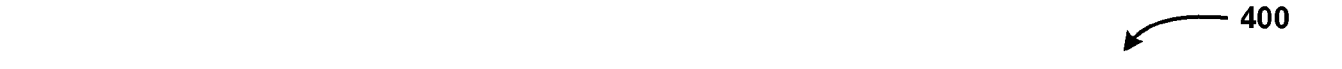
FIG. 4A
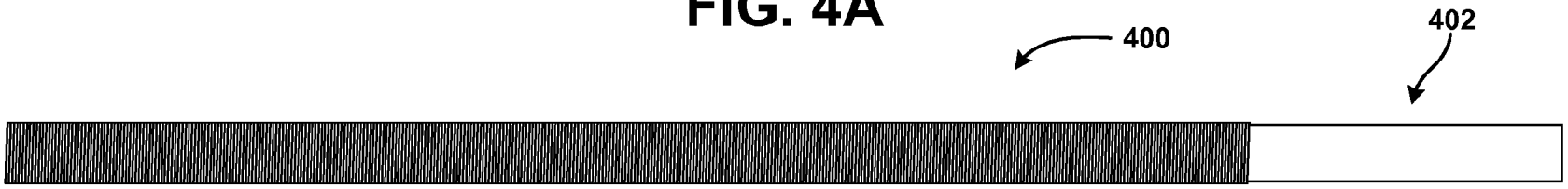
FIG. 4B
FIG. 4C
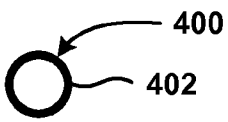
FIG. 4D
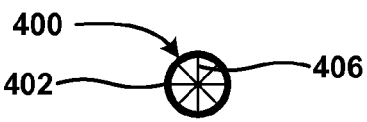
FIG. 4E

COIL-EQUIPPED FIREARM SUPPRESSOR

CROSS-REFERENCE TO RELATED APPLICATIONS

This application claims priority to U.S. Provisional Patent Application No. 61/836,508, filed Jun. 18, 2013, entitled "Improved Suppressor," which is incorporated herein by reference in its entirety. This application also claims priority to U.S. Provisional Patent Application No. 61/872,012, filed Aug. 30, 2013, entitled "Light Enhanced Firearm Suppressor," which is incorporated herein by reference in its entirety. This application also claims priority to U.S. Provisional Patent Application No. 61/892,070, filed Oct. 17, 2013, entitled "Superior Signature Suppressor," which is incorporated herein by reference in its entirety. This application also claims priority to U.S. Provisional Patent Application No. 61/892,087, filed Oct. 17, 2013, entitled "Improved Surface Treatment Suppressor," which is incorporated herein by reference in its entirety. This application is related to U.S. patent application Ser. No. 14/134,023, now U.S. Pat. No. 9,038,770, filed Dec. 19, 2013, entitled "Firearm Suppressor," which is incorporated herein by reference in its entirety. This application also is related to U.S. patent application Ser. No. 14/134,044, now allowed, filed Dec. 19, 2013, entitled Light-Enhanced Firearm Suppressor," which is incorporated herein by reference in its entirety.

TECHNICAL FIELD

This disclosure relates generally to firearm technologies. More particularly, the disclosure made herein relates to a coil-equipped firearm suppressor that is durable, light weight, economical, and can be easily disassembled and cleaned.

BACKGROUND

Unless otherwise indicated herein, the materials described in this section are not prior art to the claims in this application and are not admitted to be prior art by inclusion in this section.

Firearm suppressors are sometimes referred to as "silencers." The term "silencer," however, while being partially accurate, does not explain or identify the various functions of a well-manufactured and well-used suppressor. In particular, a suppressor functions to not only suppress an audible signature of a firearm, but also to suppress the muzzle flash and other visible signatures of firearms. As such, suppressors can be used to allow firearm use without personal hearing protection by a shooter. In military applications, suppressors can reduce detectability, thereby allowing soldiers or other entities to discharge firearms without revealing their location. Soldiers also may use suppressors to discharge firearms without compromising their ability to hear other sounds in their environment.

Because suppressors can allow shooters to discharge firearms without personal hearing protection, and may reduce the muzzle flash and other visible effects of firearm discharge, suppressors have become popular accessories with shooters. In fact, some shooters wish to acquire a suppressor for each owned firearm after firing a suppressed firearm due to the reduced sound and flash of a firearm discharge. In general, suppressors can make shooting more enjoyable.

The benefits of suppressors, however, are not limited to comfort and enjoyment. Suppressors also can be used for personal defense, military applications, hunting, and the like. In particular, because adrenaline-inducing events can result in visual distortion such as tunnel vision, depth perception issues, and the like, which may pose personal safety risks, some firearm owners equip personal defense firearms with suppressors to reduce the likelihood of such issues in a violent encounter. For military applications, suppressors can aid soldiers in stealthily attacking targets with firearms by reducing the detectability of the firearms visually and audibly.

For these and other reasons, suppressors have become popular accessories for firearm owners and users. Suppressors, however, are expensive to make and therefore are expensive to own. Additionally, the regulatory framework around suppressor manufacturing and ownership combine with the high cost of manufacturing to result in limited suppressor ownership and availability. In general, suppressors function by dissipating high pressure gases between the muzzle and an ambient environment. As such, the greater the dissipation of these gases, the more effective the suppressor.

SUMMARY

Concepts and technologies are disclosed herein for a coil-equipped firearm suppressor. In some embodiments, a coil-equipped firearm suppressor can include a housing and a baffle insert. In some embodiments, the baffle insert can include multiple coil apertures into which coils may be placed. The coils can be formed from metal or other materials such as, for example, carbon-based materials. The coils can also be mated with and/or coupled to a rod or other structure. The coils and/or rods may enhance firearm suppressor performance by increasing an available amount of surface area for dissipating gases, sound, and temperature. The coils and/or rods can extend along a length of the baffle insert. In some embodiments, the coils and/or rods only extend along part of the length of the baffle insert, while in some other embodiments, the coils and/or rods can extend along the entire length of the baffle insert.

The baffle insert and the coils and/or rods can be inserted into a firearm suppressor housing to form a coil-equipped firearm suppressor. The coil-equipped firearm suppressor can be durable, economical, and effective, among other qualities. In particular, the baffle insert can be configured to be easily removed from the firearm suppressor housing, with the coils and/or rods inserted therein, without separately removing the coils, rods, and/or baffle insert. The coils and/or rods can be removed from the baffle insert, and these and/or other components of the coil-equipped firearm suppressor can be easily cleaned and/or submerged in a cleaning solvent for eased cleaning. These and other aspects of the concepts and technologies described herein will be described herein in further detail.

According to one aspect of the concepts and technologies described herein, a coil-equipped firearm suppressor is disclosed. The coil-equipped firearm suppressor can include a firearm suppressor housing including an outer surface, an inner cavity that can accommodate a baffle insert, and an attachment mechanism that can attach the firearm suppressor housing to a barrel of a firearm. The coil-equipped firearm suppressor also can include the baffle insert. The baffle insert can include a number of baffles. The coil-equipped firearm suppressor also can include two or more coils inserted into the baffle insert.

In some embodiments, the baffle insert can be inserted into the firearm suppressor housing. In some embodiments, at least one of the two or more coils can extend less than an entire length of the baffle insert. The coil-equipped firearm suppressor also can include a rod, which can be located within at least one of the two or more coils. The rod can be hollow, or the rod can be solid. In some embodiments, at least one of the two or more coils can be formed from a carbon-based material, and in some embodiments, at least one of the two or more coils can be formed from a metal. The baffle insert can include two or more coil apertures. In some embodiments, a first coil of the two or more coils can be inserted into a first of the two or more coil apertures, and a second coil of the two or more coils can be inserted into a second of the two or more coil apertures.

According to another aspect of the concepts and technologies described herein, a coil-equipped firearm suppressor is disclosed. The coil-equipped firearm suppressor can include a firearm suppressor housing that can include an outer surface, an inner cavity that can accommodate a baffle insert, and an attachment mechanism that can be configured to attach the firearm suppressor housing at a location proximate to a barrel of a firearm. The coil-equipped firearm suppressor also can include the baffle insert, which can be configured for insertion into the inner cavity. The baffle insert can include a number of baffles and two or more coil apertures. The baffle insert also can include, or can be configured to receive, two or more coils inserted into the baffle insert.

In some embodiments, at least one of the two or more coils can extend less than an entire length of the baffle insert, in some embodiments. The coil-equipped firearm suppressor also can include a rod located within at least one of the two or more coils. In some embodiments, the two or more coils and the two or more rods can be formed from at least one metal. The baffle insert can be configured to receive and/or support coils or other signature reduction media to further enhance the effectiveness of the coil-equipped firearm suppressor.

According to yet another aspect of the concepts and technologies described herein, a baffle insert is disclosed. The baffle insert can be configured for insertion into a firearm suppressor housing including an inner cavity and an attachment mechanism that can be configured to attach the firearm suppressor housing at a location proximate to a barrel of a firearm. The baffle insert can include a number of baffles and two or more coil apertures. A first coil aperture of the two or more coil apertures can be configured to receive a first coil of two or more coils that can be inserted into the first coil aperture, and a second coil aperture of the two or more coil apertures can be configured to receive a second coil of the two or more coils that can be inserted into the second coil aperture.

In some embodiments, the baffle insert can be inserted into the firearm suppressor housing. The two or more coils also can be inserted into the baffle insert. In some embodiments, at least one of the two or more coils can extend along less than entire length of the baffle insert, while in some embodiments, at least one of the two or more coils can extend along an entire length of the baffle insert.

The foregoing summary is illustrative only and is not in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIGS. 4A-4E are line drawings illustrating various views of a coil for a coil-equipped firearm suppressor, according to various embodiments of the concepts and technologies described herein.

DETAILED DESCRIPTION

Figure 1:
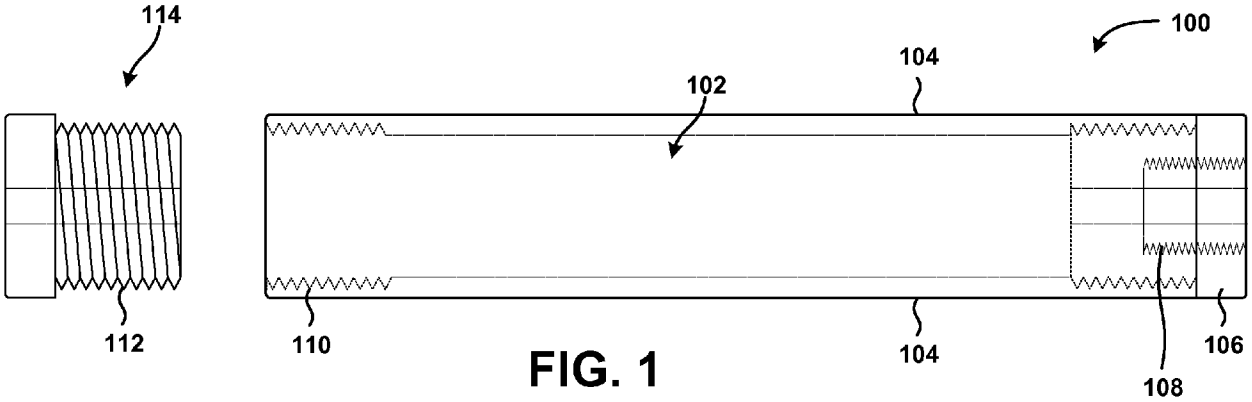
FIG. 1 is a line drawing illustrating an assembly view of a firearm suppressor housing, according to an illustrative embodiment of the concepts and technologies described herein.

The following detailed description is directed to a coil-equipped firearm suppressor. In some embodiments, a coil-equipped firearm suppressor can include a housing and a baffle insert. In some embodiments, the baffle insert can include multiple coil apertures into which coils may be located or placed. The coils can be formed from metal or other materials such as, for example, carbon-based materials. The coils can also be mated with and/or coupled to a rod or other structure. The rod may increase the rigidity of the coils and/or may be used to increase the surface area of the coils for temperature, sound, and/or pressure dissipation. Thus, the coils and/or rods may enhance firearm suppressor performance, in some embodiments. The coils and/or rods can extend along a length of the baffle insert. In some embodiments, the coils and/or rods only extend along part of the length of the baffle insert, while in some other embodiments, the coils and/or rods can extend along the entire length of the baffle insert.

The baffle insert and the coils and/or rods can be inserted into a firearm suppressor housing to form a coil-equipped firearm suppressor. The coil-equipped firearm suppressor can be durable, economical, and effective, in some embodiments. In particular, the baffle insert can be configured to be easily removed from the firearm suppressor housing, with the coils and/or rods inserted therein, without separately removing the coils, rods, and/or baffle insert. The coils and/or rods can be removed from the baffle insert, and these and/or other components of the coil-equipped firearm suppressor can be easily cleaned. These and other aspects of the concepts and technologies described herein will be described herein in further detail.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of coil-equipped firearm suppressors will be presented.

Turning to FIG. 1, aspects of a coil-equipped firearm suppressor according to various embodiments of the concepts and technologies described herein will be described in detail. In particular, FIG. 1 illustrates one illustrative embodiment of a firearm suppressor housing 100. Because the concepts and technologies described herein for providing a coil-equipped firearm suppressor can be embodied in various implementations of suppressors, it should be understood that the illustrated and described illustrative embodiment is merely one example of a suitable operating environment for the concepts and technologies described herein for providing a coil-equipped firearm suppressor. As such, the illustrated and described embodiments should not be construed as being limiting in any way of the concepts and technologies described herein.

In some embodiments, as shown in FIG. 1, a coil-equipped firearm suppressor can include a firearm suppressor housing 100. The firearm suppressor housing 100 can be formed from an assembly of two or more components. In some embodiments, the firearm suppressor housing 100 may be formed from a substantially continuous piece of material such as a metal rod or metal tube that can be machined by various processes and/or tools. According to various embodiments, including the embodiment shown in FIG. 1, the firearm suppressor housing 100 can be formed as a cylindrical structure. The firearm suppressor housing 100 can include an inner cavity or void ("inner cavity") 102, which can be defined by an outer surface 104.

It can be appreciated that the firearm suppressor housing 100 can be configured to house a baffle, a baffle insert, and/or other structures and/or elements such as the baffle insert described herein, though this is not necessarily the case. Various embodiments of baffle insert assemblies, baffles, baffle inserts, and/or other structures or elements that can be located within the inner cavity 102 are illustrated and described in U.S. Provisional Patent Application No. 61/836,508, filed Jun. 18, 2013, entitled "Improved Suppressor," which is incorporated herein by reference in its entirety; U.S. Provisional Patent Application No. 61/872,012, filed Aug. 30, 2013, entitled "Light Enhanced Firearm Suppressor," which is incorporated herein by reference in its entirety; U.S. Provisional Patent Application No. 61/892,070, filed Oct. 17, 2013, entitled "Superior Signature Suppressor," which is incorporated herein by reference in its entirety; U.S. patent application Ser. No. 14/134,023, filed Dec. 19, 2013, entitled "Firearm Suppressor," which is incorporated herein by reference in its entirety; and U.S. patent application Ser. No. 14/134,044, filed Dec. 19, 2013, entitled Light-Enhanced Firearm Suppressor," which is incorporated herein by reference in its entirety. Because other baffles, baffle inserts, baffle insert assemblies, and/or other structures and/or elements are possible and are contemplated, it should be understood that these examples are illustrative and therefore should not be construed as being limiting in any way.

The firearm suppressor housing 100 also can include and/or can engage a leading edge cap 106. The leading edge cap 106 can include and/or can be configured to engage barrel threads 108 or other structures. According to various embodiments of the concepts and technologies described herein, the barrel threads 108 are configured to engage threads or other structures of a barrel of a firearm (not shown in FIG. 1). Thus, the barrel threads 108 can be used to hold a coil-equipped firearm suppressor in an operating configuration with respect to a firearm, as generally is understood by one familiar with the operation of firearm suppressors. Because the leading edge cap 106 and the barrel threads 108 are generally understood structural elements of firearm suppressors, these elements are not further described herein. Also, because the barrel threads 108 can be replaced and/or supplemented with alternative connection mechanisms, it should be understood that the threads are merely illustrative of one contemplated embodiment and therefore should not be construed as being limiting in any way.

The firearm suppressor housing 100 and/or the components of the firearm suppressor housing 100 may be formed by various processes and/or materials. According to various embodiments of the concepts and technologies described herein, the firearm suppressor housing 100, or a portion thereof, can be formed from metals and/or alloys, resins, polymers, and/or other materials. In some embodiments, for example, the firearm suppressor housing 100 and/or a portion thereof can be formed from a metal and/or alloy such as steel, aluminum, titanium, brass, copper, magnesium alloys, aluminum alloys, other metals or alloys, combinations thereof, or the like. In some embodiments, for example, the firearm suppressor housing 100, or a portion thereof, can be formed from resins such as epoxy resins, or the like. In some embodiments, for example, the firearm suppressor housing 100, or a portion thereof, can be formed from one or more polymers such as various thermoplastics, polypropylene, polycarbonates, aerogel, graphite filled NYLON, phenolics, polyimides, and/or other polymers, combinations thereof, or the like.

The firearm suppressor housing 100 can be formed using various processes such as, for example, extrusion, machining, injection molding, casting, combinations thereof, or the like. In one contemplated embodiment, the firearm suppressor housing 100 is formed from an extruded or formed metal tube (e.g., an extruded aluminum tube) that can be machined to obtain the various structures visible in FIG. 1 as well as additional or alternative structures. In another contemplated embodiment, the firearm suppressor housing 100, or a portion thereof, can be formed from a metal rod (e.g., an extruded or formed aluminum or steel rod or pipe) that can be machined using various tools and/or processes to obtain the firearm suppressor housing 100. Because various manufacturing processes can be used and/or selected based upon various needs (cost, materials, time, etc.), it should be understood that these examples are illustrative and therefore should not be construed as being limiting in any way.

As noted above, the outer surface 104 of the firearm suppressor housing 100 and/or the entire firearm suppressor housing 100 can be treated for various purposes. In some embodiments, for example, the outer surface 104 of the firearm suppressor housing 100, or the entire firearm suppressor housing 100, can be treated with coatings, paints, chemical processes, or the like. For example, in some embodiments the outer surface 104 of the firearm suppressor housing 100 can be treated with one or more processes commonly referred to as "gun bluing." For example, the outer surface 104 of the firearm suppressor housing 100, or the entire firearm suppressor housing 100, can be treated using an electrochemical conversion coating process such as fume bluing, cold bluing, hot bluing, niter bluing, rust bluing, browning, or the like. The outer surface 104 of the firearm suppressor housing 100, or the entire firearm suppressor housing 100, also can be polished, sandblasted, or otherwise treated to provide a shiny, satin, or unfinished surface appearance. The outer surface 104 of the firearm suppressor housing 100, or the entire firearm suppressor housing 100, can be given an anodized coating treatment, if desired. Because other processes and/or coatings are contemplated and are possible, it should be understood that these examples are illustrative and therefore should not be construed as being limiting in any way.

The firearm suppressor housing 100 also can be treated with other processes to, for example, enhance strength, add corrosion resistance, for aesthetic purposes, combinations thereof, or the like. In some embodiments, the firearm suppressor housing 100 is formed from titanium and is coated or laminated with films, coatings, or the like. In another contemplated embodiment, the firearm suppressor housing 100 can be formed from titanium and treated with a heat anodization process such as the heat anodization process illustrated and described in U.S. Provisional Patent Application No. 61/892,087, filed Oct. 17, 2013, entitled "Improved Surface Treatment Suppressor," which is incorporated herein by reference in its entirety. Because additional and/or alternative treatment processes are possible and are contemplated, it should be understood that these examples are illustrative and therefore should not be construed as being limiting in any way.

Some embodiments of the coil-equipped firearm suppressor can include one or more components treated with a heat anodization process mentioned above. In particular, one contemplated embodiment includes a firearm suppressor housing 100 that is made from titanium that is treated with a heat anodized process to provide a durable aesthetic appearance. It should be understood that these examples are illustrative and therefore should not be construed as being limiting in any way.

The firearm suppressor housing 100 also can include trailing edge cap attachment threads 110. The trailing edge cap attachment threads 110 can be configured to engage reciprocal housing attachment threads 112 of a trailing edge cap 114 or other attachment such as a lighting attachment, or the like. The trailing edge cap attachment threads 110 can be replaced and/or supplemented with other attachment mechanisms, if desired, such as rivets, bolts, compression fittings, pins, combinations thereof, or the like Because the trailing edge cap attachment threads 110 can be replaced and/or supplemented with additional and/or alternative attachment mechanisms, it should be understood that the housing attachment threads 112 of the trailing edge cap 114 can be replaced and/or supplemented with additional and/or alternative connection mechanisms and/or reciprocal connection mechanisms.

Figure 2:
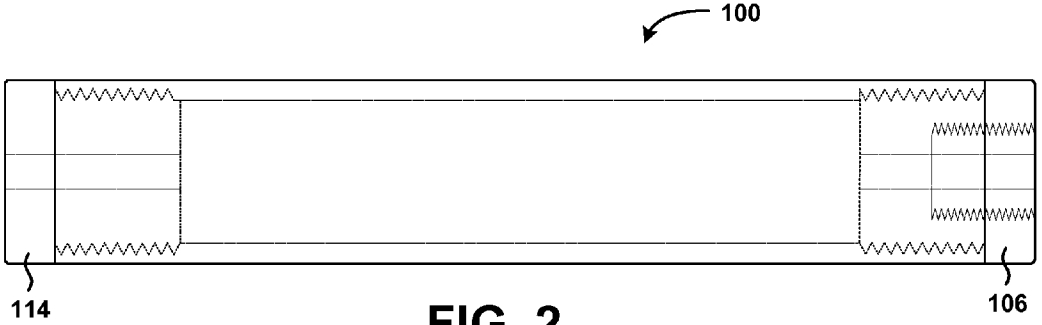
FIG. 2 is a line drawing illustrating the firearm suppressor housing shown in FIG. 1, according to another illustrative embodiment of the concepts and technologies described herein.

According to various embodiments, as shown with collective reference to FIGS. 1 and 2, the trailing edge cap 114 can be connected to the firearm suppressor housing 100 by mating connection mechanisms on the firearm suppressor housing 100 and the trailing edge cap 114, for example the trailing edge cap attachment threads 110 and the housing attachment threads 112, respectively. Although not visible in FIGS. 1-2, it should be understood that other structures can be located between the firearm suppressor housing 100 and the trailing edge cap 114, for example a plastic or silicone washer, padding, combinations thereof, or the like. Furthermore, as will be more clearly understood with reference to FIGS. 3A-6 below, a baffle, baffle insert, coils, rods, and/or other structures and/or components can be located within the firearm suppressor housing to obtain and/or form a coil-equipped firearm suppressor. These and other aspects of the concepts and technologies described herein will be further illustrated and described below.

Turning now to FIGS. 3A-3F, additional aspects of the concepts and technologies described herein for coil-equipped firearm suppressors will be described in detail. In particular, FIGS. 3A-3F illustrate various views of a baffle insert 300 for a coil-equipped firearm suppressor, according to one illustrative embodiment of the concepts and technologies described herein. As will be more clearly understood with reference to the description of FIGS. 3A-6 below, the various dimensions, arrangement, and/or configuration of the various components of the baffle insert 300 can be varied for particular applications and/or needs. As such, it should be understood that the embodiment shown in FIGS. 3A-3F is illustrative and therefore should not be construed as being limiting in any way.

The baffle insert 300 can be formed using various manufacturing processes such as, for example, extrusion, machining, injection molding, casting, combinations thereof, or the like. In one contemplated embodiment, the baffle insert 300 can be formed from a rod or block of material that can be machined to obtain the various structures of the baffle insert 300 described herein as well as additional or alternative structures. The baffle insert 300 and/or portions thereof can be formed from metals or alloys such as aluminum, steel, copper, titanium, brass, or the like.

The baffle insert 300 and/or portions thereof also can be formed from other materials. For example, the baffle insert 300 and/or one or more portions thereof can be formed from polymers such as thermoplastics, acrylics, NYLON and/or NYLON derivatives, and/or other plastics and/or polymers that are suitable to the high pressure and/or temperature requirements of firearm suppressors. The baffle insert 300 and/or portions thereof also can be formed from various epoxies and/or resins, as well as aerogel and/or aerogel derivatives such as various aerogel alloys, combinations thereof, or the like. It should be understood that these examples are illustrative and therefore should not be construed as being limiting in any way.

Figure 3A:
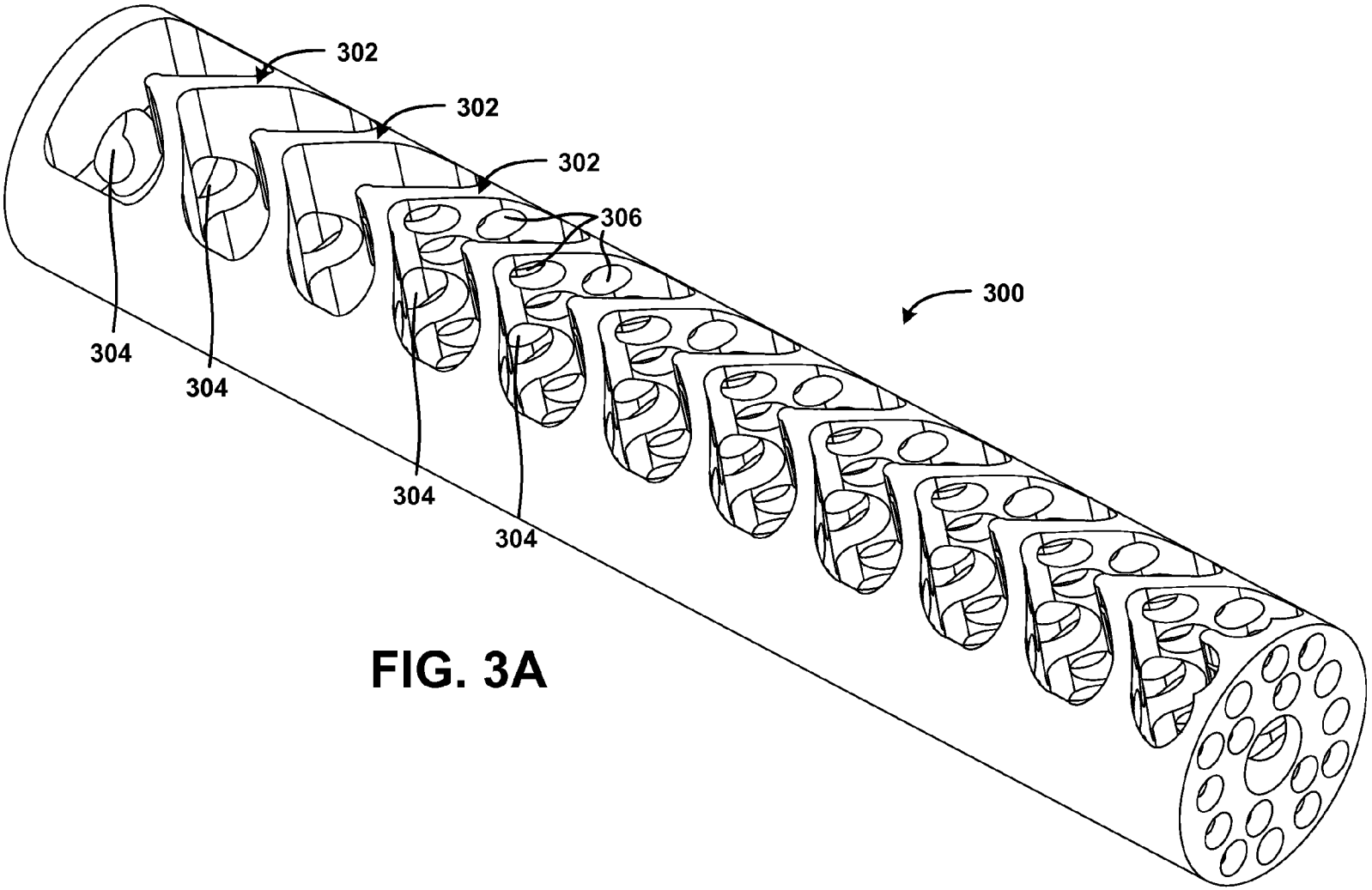
FIGS. 3A-3F are line drawings illustrating various views of a baffle insert for a coil-equipped firearm suppressor, according to one illustrative embodiment of the concepts and technologies described herein.

As can be seen in FIG. 3A, in which a perspective view of the baffle insert 300 is shown, the baffle insert 300 can include a number of baffle surfaces, baffles, or other structures ("baffles") 302. The baffles 302 can be arranged at various angles with respect to one another, and need not be arranged and/or situated in a similar fashion to the arrangement and situation illustrated in FIG. 3A. Similarly, while some of the baffles 302 shown in FIG. 3A are illustrated as being substantially similar to one another in terms of dimensions, configurations, and/or arrangement, it should be understood that this is not necessarily the case. As such, the illustrated configuration should be understood as being merely illustrative of one contemplated embodiment that is provided to explain various aspects of the concepts and technologies described herein, and therefore should not be construed as being limiting in any way.

In some embodiments, the baffle insert 300 can be formed from a single piece of material. Of course, it should be understood that the baffle insert 300 can be formed from multiple pieces of material and/or that multiple baffle insert assemblies can replace a single baffle insert 300, if desired. Thus, for example, two or more baffle insert assemblies can be stacked, arranged, and/or connected together to provide functionality that may be different, similar, or even identical to a single baffle insert 300 as disclosed herein. As such, the embodiment of a baffle insert 300 that is formed from a single piece of material should be understood as being only one contemplated embodiment of the concepts and technologies described herein and therefore should not be construed as being limiting in any way.

In some embodiments, the baffle insert 300 can be formed from a cylindrical rod of material such as a baffle insert blank, though this is not necessarily the case. In particular, non-cylindrical blanks can be used to form the baffle insert, for example via use of a lathe, mill, and/or other manufacturing equipment. In one contemplated embodiment, a cylindrical blank can be machined using a CNC mill and/or lathe to form the baffle insert 300. It should be understood that this example is illustrative and therefore should not be construed as being limiting in any way.

The baffles 302 also can include a main aperture 304 through which a bullet or other projectile(s) can pass after being fired by a firearm. It therefore can be appreciated that the main aperture 304 can be aligned with a barrel of a firearm, and that the main aperture 304 can be sized, dimensioned, and/or otherwise configured based upon a caliber of ammunition or firearm with which the coil-equipped firearm suppressor is used. It also should be appreciated that the main aperture 304 can accommodate other structures such as sighting instruments, cleaning rods and/or tools, lights or lighting devices, combinations thereof, or the like.

As shown in FIG. 3A, the baffles 302 also can include one or more coil apertures 306. The coil apertures 306 can be configured to accommodate a coil, spring, or other structures that can be used to supplement and/or enhance the suppression abilities of the coil-equipped firearm suppressor. As will be more clearly understood with reference to FIGS. 4A-6 below, the coil apertures 306 can be configured to accommodate multiple coils that can be used to improve the suppression capabilities of the coil-equipped firearm suppressor, relative to firearm suppressors that do not include coils. As will be shown in FIGS. 5-6, coils and/or structures can be inserted into the baffle insert 300, and the baffle insert 300 with the coils can be inserted into the firearm suppressor housing 100 to obtain or form a coil-equipped firearm suppressor. It should be understood that this example is illustrative and therefore should not be construed as being limiting in any way.

Figure 3B:
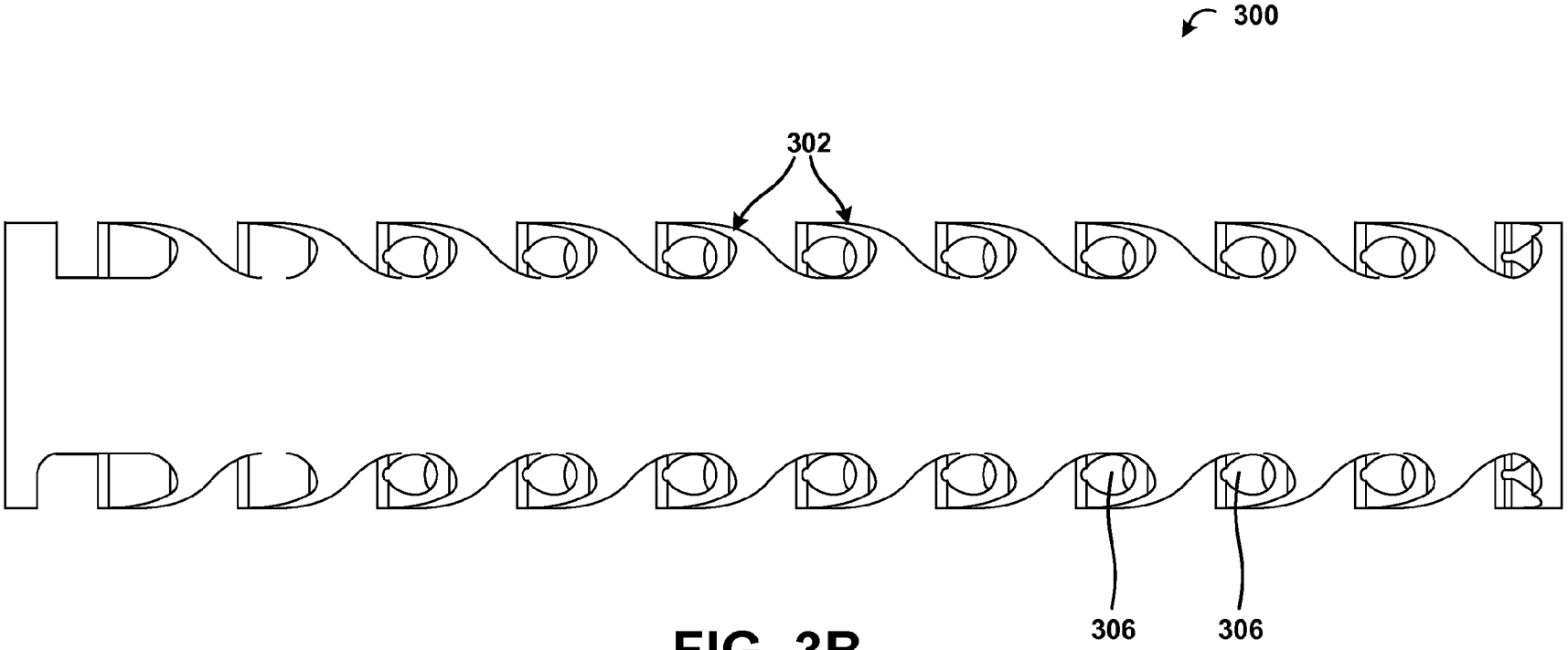

Referring additionally to FIG. 3B, additional aspects of the concepts and technologies described herein for a coil-equipped firearm suppressor will be described in detail. In particular, FIG. 3B illustrates a side view of the baffle insert 300 shown in FIG. 3A, according to one embodiment. It should be understood that the dimensions shown in FIG. 3B are illustrative of one contemplated embodiment, and that the various structures and/or relationships between the structures of the baffle insert 300 can be varied based upon caliber, suppression needs or desires, and/or other considerations associated with the coil-equipped firearm suppressor. For example, the number of coil apertures 306 can be varied (increased or decreased), the length of the coils to be used with the baffle insert 300 can be varied, and/or the like. As such, the illustrated embodiment is illustrative and should not be construed as being limiting in any way.

Figure 3C:
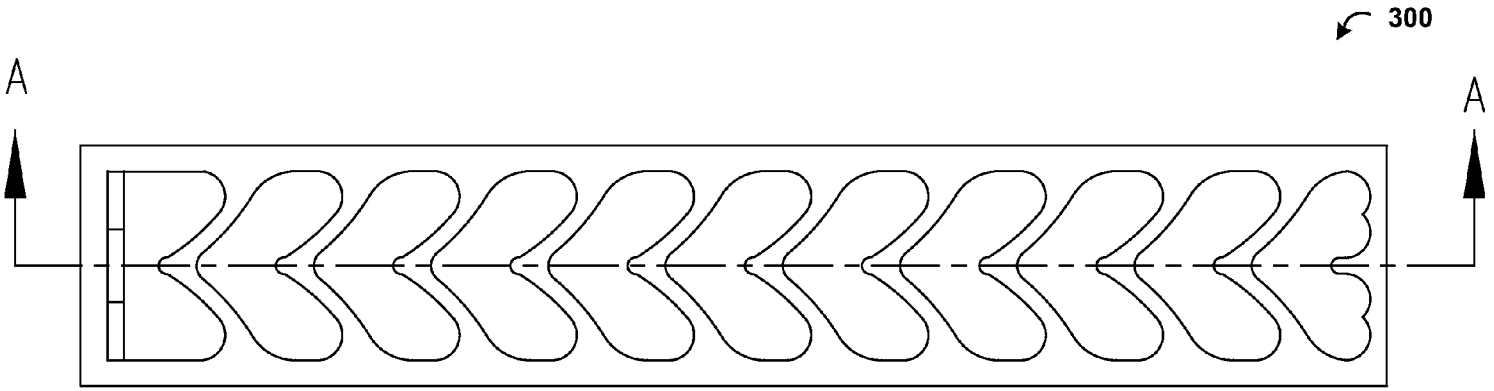
Figure 3E:
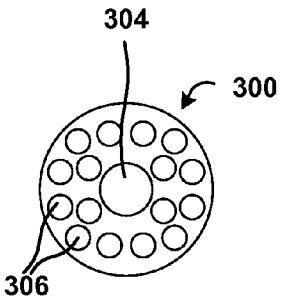
Figure 3D:
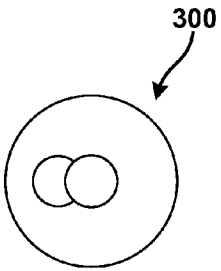

Referring additionally to FIGS. 3C-3E, additional aspects of the concepts and technologies described herein for a coil-equipped firearm suppressor will be described in detail. In particular, FIG. 3C illustrates top view of the baffle insert 300 shown in FIGS. 3A-3B, FIGURE three-dimensional illustrates a back view of the baffle insert 300 shown in FIGS. 3A-3C, and FIG. 3E illustrates a front view of the baffle insert 300 shown in FIGS. 3A-3D, according to one embodiment. It should be understood that the configuration, relative dimensions, and/or other aspects of the baffle insert 300 shown in FIGS. 3C-3D are illustrative of one contemplated embodiment, and that the various structures and/or relationships between the structures of the baffle insert 300 can be varied as noted above. As such, the illustrated embodiment is illustrative and should not be construed as being limiting in any way.

As shown in FIG. 3E, the baffle insert 300 can include multiple coil apertures 306. In some embodiments, such as the embodiment shown in FIG. 3E, the coil apertures 306 can be arranged about a radius relative to the main aperture 304. In some embodiments, the coil apertures 306 can be arranged about two or more radii relative to the main aperture 304. Because the coil apertures 306 may not be evenly spaced and/or arranged about a particular radius, it should be understood that these examples are illustrative and therefore should not be construed as being limiting in any way. Furthermore, it should be understood that coils of multiple sizes, lengths, and/or other dimensions may be used in accordance with the embodiments of the concepts and technologies described herein. Thus, the coil apertures 306 may not be evenly sized as illustrated in FIG. 3E.

Figure 3F:
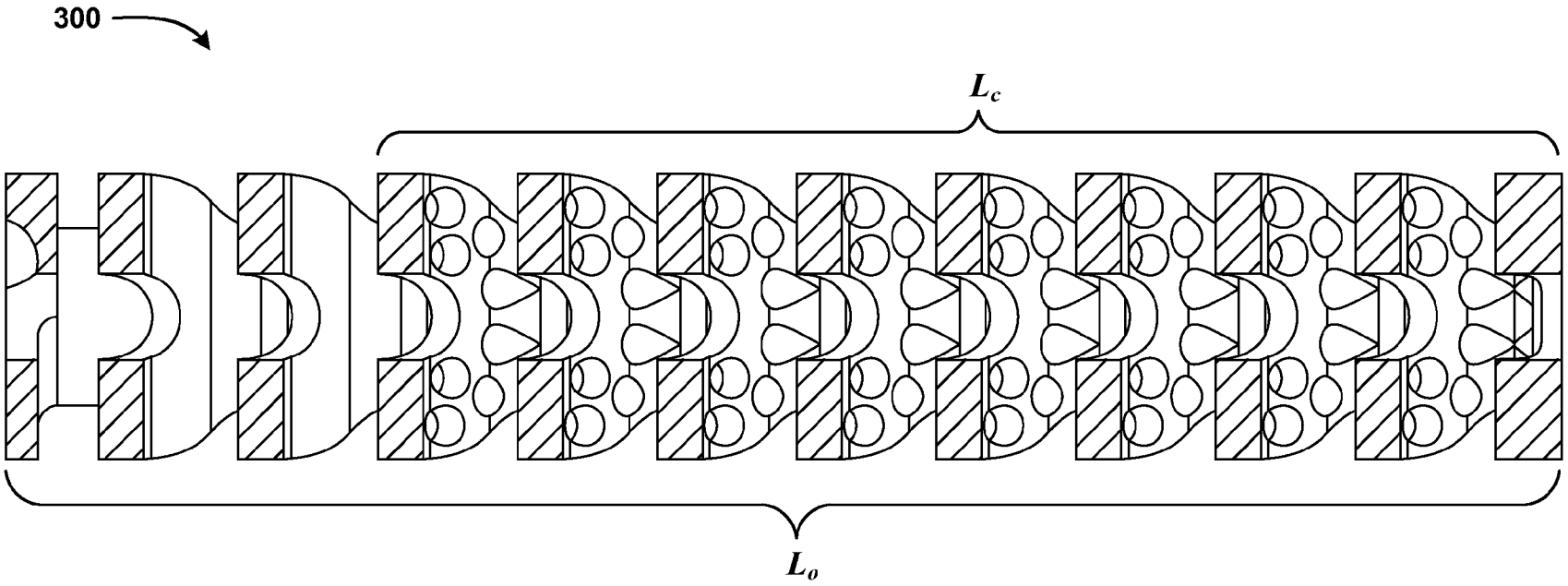

Referring now to FIG. 3F, additional aspects of the concepts and technologies described herein for a coil-equipped firearm suppressor will be described in detail. FIG. 3F illustrates a cut-away view of the baffle insert 300 shown in FIGS. 3A-3E, as viewed along the line A-A shown in FIG. 3C. It should be understood that this example is illustrative and therefore should not be construed as being limiting in any way.

It should again be noted that the dimensions and/or relationships illustrated in FIG. 3F are illustrative of one contemplated embodiment, and that the various structures and/or relationships between the structures of the baffle insert 300 can be varied based upon caliber, suppression needs or desires, and/or other considerations associated with the coil-equipped firearm suppressor. For example, the number of coil apertures 306 can be varied (increased or decreased), the length of the coils to be used with the baffle insert 300 can be varied, and/or the like. As such, the illustrated embodiment is illustrative and should not be construed as being limiting in any way.

As shown in FIG. 3F, the baffle insert 300 can have an overall length $L_o$. The baffle insert 300 also can have an associated coil length $L_c$. The overall length $L_o$ can correspond to a length of the baffle insert 300, and the coil length $L_c$ can correspond to a length of one or more coils that are inserted into the baffle insert 300. It should be understood from the above description that these lengths as well as the arrangement, proportions, and/or other associated structure configurations and/or relationships can be varied for various reasons. As such, it should be understood that this example is illustrative and therefore should not be construed as being limiting in any way.

As generally is understood, firearm suppressors such as a coil-equipped firearm suppressor can be formed from an embodiment of the firearm suppressor housing 100, an embodiment of the baffle insert 300, and an embodiment of the coils as described herein can function by shearing hot expanding gasses expelled from a muzzle of a firearm during firing of the firearm. In particular, as the gases expand out of the muzzle of the firearm barrel and into the coil-equipped firearm suppressor, the baffles 302 of the baffle insert 300 can shear the gases, giving the gases time to cool and dissipate, which in turn can reduce the audible and visible signature of a firearm firing. Similarly, the pressure discharge that typically results from firing a firearm can be reduced by the use of the coil-equipped firearm suppressor, which can further reduce audible signatures of firearm discharges. Still further, coils or other media such as the coils illustrated and described with reference to FIGS. 4A-6 below can further enhance the dissipative effects of the coil-equipped firearm suppressor illustrated and described herein.

In particular, the coils illustrated and described herein, particularly with reference to FIGS. 4A-6 below, can be added to increase the dissipation of gases and temperature. While some shooters supplement suppressors by adding steel wool, or the like, such additions can be problematic. In particular, steel wool may deteriorate quickly due to the pressures and temperature that may exist within a firearm suppressor. Thus, particles of steel wool may fill a firearm suppressor and/or enter the firearm through the muzzle. Thus, coils as illustrated and described herein can be configured to withstand the pressures and temperatures of the firearm suppressor environment, thereby preventing disintegration of the coils. The coils also can be removed from the baffle insert 300 to allow cleaning of the baffle insert 300 and/or the coils.

It should be appreciated that, depending upon the caliber of firearm for which the coil-quipped firearm suppressor is intended, the angles, curves, configurations, diameters, offset angles, and/or other aspects of the baffles 302 and/or other features of the baffle insert 300; a material, dimensions, and/or shape of the firearm suppressor housing 100; and numbers of, sizes and/or configurations of, and/or other aspects of the coils for use in the coil-equipped firearm suppressor may be modified or altered to alter the suppressive effect of the coil-equipped firearm suppressor. At times, the considerations of suppressive effect may be balanced against the impact on projectile performance (e.g., by slowing the speed of the projectile) and/or durability of the coils and/or other components of the coil-equipped firearm suppressor, and as such, the arrangement and/or configuration of the baffles 302 of the baffle insert 300 and the coils, as well as dimensions and/or configurations of the firearm suppressor housing 100, the baffle insert 300 and/or various aspects of the coils disclosed herein may be tailored for various purposes. Thus, it should be understood that the illustrated and described examples are illustrative and therefore should not be construed as being limiting in any way.

Turning now to FIGS. 4A-4E, additional aspects of the concepts and technologies described herein for coil-equipped firearm suppressors will be described in detail. In particular, FIG. 4A is a line drawing illustrating a side view of a coil 400, according to one embodiment of the concepts and technologies described herein, and FIG. 4B is a line drawing of another coil 400 that is mated and/or assembled with a rod 402. It should be understood that the illustrated coils 400 and/or rods 402 are illustrative and therefore should not be construed as being limiting in any way.

With reference to FIG. 4A, it should be understood that the coil 400 can be similar to a spring, if desired. The coil 400 may be formed from a wound wire or other material that can be tightly or loosely wound. Thus, it can be appreciated that the coils 400 can be inexpensively manufactured, in some embodiments. The coils 400 can be formed from various materials. In some embodiments, the coils 400 are formed from metal and/or alloys, while in some other embodiments, the coils 400 can be formed from plastics, carbon-based materials, other materials, or the like. As such, it should be understood that these examples are illustrative and therefore should not be construed as being limiting in any way.

With reference to FIG. 4B, it should be understood that the rod 402 can be used in conjunction with the coils 400 to increase a surface area of the coil 400 and/or an assembly formed with the coil 400, which can result in increased cooling of the coil 400. The increased cooling provided by the coil 400 can be used to increase the suppressive effects of the coil-quipped firearm suppressor relative to a firearm suppressor without coils 400. It should be understood that this example is illustrative and therefore should not be construed as being limiting in any way.

As shown in FIG. 4C, the rod 402 can be formed from a solid piece of material, in some embodiments. As shown in FIG. 4D, the rod 402 also can be formed as a hollow tube, in some embodiments. As shown in FIG. 4E, the rod 402 can be formed from an extruded piece of material or otherwise can be formed to provide ribs or other structures to act as heat sinks ("sinks") 406. Thus, some embodiments of the concepts and technologies described herein can provide rods 402 that dissipate heat from the coils 400 and/or other structures within the coil-equipped firearm suppressor to enhance the effectiveness of the firearm suppressor. It should be understood that these examples are illustrative and therefore should not be construed as being limiting in any way.

As will be illustrated and described in more detail below, the coils 400 and/or the rods 402 can be configured to extend through an entire length of the baffle insert 300, in some embodiments. In some other embodiments, the coils 400 and/or the rods 402 can be configured to extend through a partial length of the baffle insert 300. It should be understood that this example is illustrative and therefore should not be construed as being limiting in any way.

The arrangement, configuration, and/or size of the baffles 302, the baffle insert 300, the coils 400, and/or the rods 402 and/or other structures of a coil-equipped firearm suppressor can affect the expansion and/or temperature of gasses escaping from a firearm during firing. Thus, the baffle insert 300, the coils 400, and/or the rods 402 can be configured and/or arranged based upon various performance, design, and/or other considerations to control the expansion of gas, the temperature of the gas, and/or otherwise to control the explosion associated with the firing of a firearm.

For example, if an embodiment of the coil-equipped firearm suppressor is being used primarily to control visible muzzle blast associated with a firearm, the baffle insert 300, the coils 400, and the rods 402 may be configured in a first arrangement, while if an embodiment of the coil-quipped firearm suppressor is being used primarily to control audible muzzle blast associated with a firearm, the baffle insert 300, the coils 400, and the rods 402 may be configured in a second arrangement. Also, although not visible in the FIGURES, the baffles 302, the baffle insert 300, the coils 400, and/or the rods 402 can be reinforced with various structures to increase the strength of the baffles 302, the baffle insert 300, the coils 400, and/or the rods 402. Because the numerous modifications, configurations, and/or arrangements of the baffle insert 300, the coils 400, the rods 402, and thereby the coil-equipped firearm suppressor are too numerous to illustrate, it should be understood that the illustrated examples are merely illustrative of some contemplated embodiments and therefore should not be construed as being limiting in any way.

According to various embodiments of the concepts and technologies described herein, the baffle insert 300 used to form the coil-equipped firearm suppressor can be formed from sheet metal. Some examples of such baffle inserts 300 are illustrated and described in U.S. patent application Ser. No. 14/134,023, filed Dec. 19, 2013, entitled "Firearm Suppressor," which is incorporated herein by reference in its entirety.

According to various embodiments of the concepts and technologies described herein, cleaning of a coil-equipped firearm suppressor can be simplified relative to cleaning a stacked cone or other similar firearm suppressor. In particular, the baffle insert 300 can be removed from the firearm suppressor housing 100 as a single piece, and the coils 400 and/or rods 402 can be removed from the baffle insert 300. The baffle insert 300, the coils 400, and the rods 402 can be cleaned with various solvents and/or immersed in a solvent bath, for example.

Furthermore, because the expanding gases produced during firearm discharges can produce or include particles such as gunpowder residue, lubricant residue, bullet residue, barrel material residue, or the like, the baffles inserted into other firearm suppressors sometimes are difficult to remove from a housing. The concepts and technologies described herein can provide embodiments of the coil-equipped firearm suppressor that allow gripping of the baffle insert 300 and removal of the baffle insert 300 from the firearm suppressor housing 100 with the coils 400 and/or rods 402 mated or connected thereto, which can be used to provide easy cleaning of the coil-equipped firearm suppressor and/or its various components as noted above. It should be understood that this example is illustrative and therefore should not be construed as being limiting in any way.

Because the baffle insert 300 can be formed from lightweight materials such as titanium, or the like, the concepts and technologies described herein also can provide embodiments of the baffle insert 300 that are lightweight relative to other suppressor designs. Similarly, the coils 400 and/or the rods 402 can be formed from lightweight materials. Because low weight can be beneficial for military, police, home defense, and/or other applications, as well as more comfortable for recreational firearm shooting, embodiments of the concepts and technologies described herein can provide improvements in terms of weight reduction relative to other baffle designs. It should be understood that this example is illustrative and therefore should not be construed as being limiting in any way.

Figure 5:
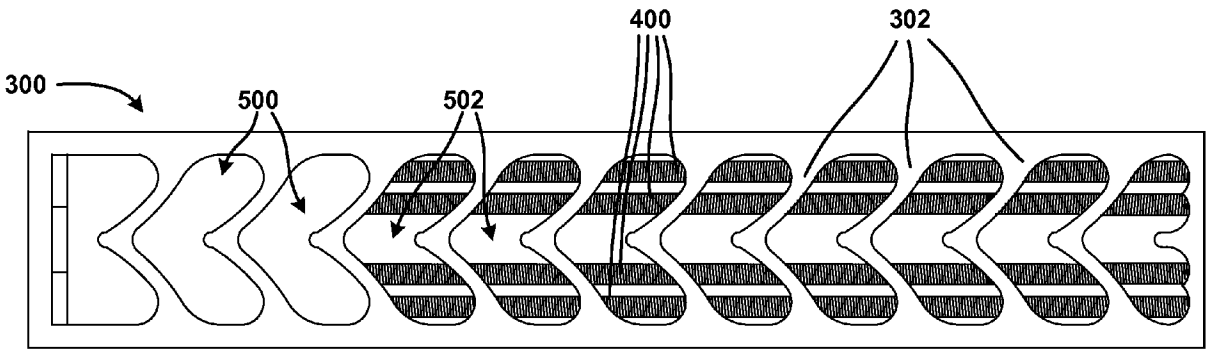
FIG. 5 is a line drawing illustrating coils inserted into a baffle insert, according to one illustrative embodiment of the concepts and technologies described herein.

Turning now to FIG. 5, additional aspects of the concepts and technologies described herein for coil-equipped firearm suppressors will be described in detail. In particular, FIG. 5 is a line drawing illustrating a side view of a baffle insert 300 such as the baffle insert illustrated and described herein with reference to FIGS. 3A-3F, assembled with multiple coils 400 such as the coils 400 shown in FIG. 4A, according to one embodiment of the concepts and technologies described herein. Although not visible in FIG. 5, it should be understood that rods 402 can be inserted into one or more of the coils 400. It should be understood that the illustrated coils 400 and/or rods 402 are illustrative and therefore should not be construed as being limiting in any way.

As shown in FIG. 5 and as explained above, the coils 400 can extend through a portion of the length of the baffle insert 300, if desired. In some other embodiments, the coils 400 can extend through the entire length of the baffle insert 300. In some embodiments, reducing the length of the coils 400 as shown in FIG. 5 can increase the durability of a coil-equipped firearm suppressor that includes a baffle insert 300 and the coils 400. In particular, the pressure and temperature of gasses in a firearm suppressor can be highest at or near the muzzle of the firearm barrel. Thus, a temperature and/or pressure of air within the spaces 500 illustrated in FIG. 5 can be higher than a temperature and/or pressure of air within the spaces 502 shown in FIG. 5. Thus, coils 400 and/or rods 402 may deteriorate quickly if the coils 400 and/or rods 402 extend into the spaces 500. As such, some embodiments of the concepts and technologies described herein use coils 400 and/or rods 402 that extend less than an entire length of the baffle insert 300. It should be understood that this example is illustrative and therefore should not be construed as being limiting in any way.

Figure 6:
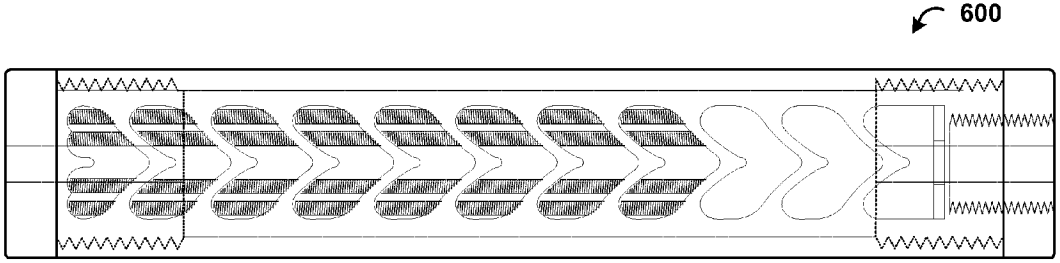
FIG. 6 is a line drawing illustrating a coil-equipped firearm suppressor, according to one embodiment of the concepts and technologies described herein.

Turning now to FIG. 6, additional aspects of the concepts and technologies described herein for coil-equipped firearm suppressors will be described in detail. In particular, FIG. 6 is a line drawing illustrating a side view of a coil-equipped firearm suppressor 600, according to one embodiment of the concepts and technologies described herein. As shown in FIG. 6, the coil-equipped firearm suppressor 600 can be formed by inserting coils 400 and/or rods 402 into the baffle insert 300, and inserting the baffle insert 300 (with the coils 400 and/or rods 402) into the firearm suppressor housing 100. It should be understood that this example is illustrative and therefore should not be construed as being limiting in any way.

While various embodiments of the concepts and technologies described herein have been described as including coils 400 and/or the rods 402, it should be understood that various embodiments of the concepts and technologies described herein can omit the coils 400 and/or the rods 402, or can substitute one or more of the coils 400 and/or the rods 402 with other structures or devices. In particular, in some embodiments of the baffle insert 300, one or more of the coil apertures 306 may be left empty (e.g., may not house a coil 400 and/or a rod 402). Additionally, or alternatively, only rods 402 may be placed into the coil apertures 306 in some embodiments, or only coils 400 may be used in some embodiments.

Still further, the coil apertures 306, or one or more of the coil apertures 306, may be used to house other structures or devices instead of, or in addition to, the coils 400 and/or the rods 402. In particular, in some embodiments of the concepts and technologies described herein, a battery, laser device, a sighting device, or other devices or structures can be received by and/or housed in one or more of the coil apertures 306. Thus, while the coil apertures 306 are illustrated and described as housing coils 400 and/or rods 402, it should be understood that some embodiments of the concepts and technologies described herein may use the coil apertures 306 to receive and/or house other structures and/or devices. It should be understood that these examples are illustrative and therefore should not be construed as being limiting in any way.

Based on the foregoing, it should be appreciated that embodiments of a coil-equipped firearm suppressor have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A coil-equipped firearm suppressor comprising:

a firearm suppressor housing comprising an outer surface, an inner cavity that accommodates a baffle insert, and an attachment mechanism that is configured to attach the firearm suppressor housing to a barrel of a firearm;

the baffle insert, wherein the baffle insert comprises a plurality of baffles; and a plurality of coils inserted into the baffle insert.

2. The coil-equipped firearm suppressor of claim 1, wherein the baffle insert is inserted into the firearm suppressor housing.

3. The coil-equipped firearm suppressor of claim 1, wherein at least one of the plurality of coils extends less than an entire length of the baffle insert.

4. The coil-equipped firearm suppressor of claim 1, further comprising a rod located within at least one of the plurality of coils.

5. The coil-equipped firearm suppressor of claim 4, wherein the rod is hollow.

6. The coil-equipped firearm suppressor of claim 4, wherein the rod is solid.

7. The coil-equipped firearm suppressor of claim 1, wherein at least one of the plurality of coils is formed from a carbon-based material.

8. The coil-equipped firearm suppressor of claim 1, wherein at least one of the plurality of coils is formed from a metal.

9. The coil-equipped firearm suppressor of claim 1, wherein the baffle insert further comprises a plurality of coil apertures.

10. The coil-equipped firearm suppressor of claim 9, wherein a first coil of the plurality of coils is inserted into a first of the plurality of coil apertures, and wherein a second coil of the plurality of coils is inserted into a second of the plurality of coil apertures.

11. A coil-equipped firearm suppressor comprising:

a firearm suppressor housing comprising an outer surface, an inner cavity that accommodates a baffle insert, and an attachment mechanism that is configured to attach the firearm suppressor housing to a barrel of a firearm;

the baffle insert, wherein the baffle insert comprises a plurality of baffles and a plurality of coil apertures; and a plurality of coils inserted into the baffle insert, wherein a first coil of the plurality of coils is inserted into a first of the plurality of coil apertures, and wherein a second coil of the plurality of coils is inserted into a second of the plurality of coil apertures.

12. The coil-equipped firearm suppressor of claim 11, wherein the baffle insert is inserted into the firearm suppressor housing.

13. The coil-equipped firearm suppressor of claim 11, wherein at least one of the plurality of coils extends less than an entire length of the baffle insert.

14. The coil-equipped firearm suppressor of claim 11, further comprising a rod located within at least one of the plurality of coils.

15. The coil-equipped firearm suppressor of claim 14, wherein the plurality of coils and the rod are formed from at least one metal.

16. A baffle insert configured for insertion into a firearm suppressor housing comprising an inner cavity and an attachment mechanism that is configured to attach the firearm suppressor housing at a location proximate to a barrel of a firearm, the baffle insert comprising:

a plurality of baffles and a plurality of coil apertures, wherein a first coil aperture of the plurality of coil apertures is configured to receive a first coil of a plurality of coils that is inserted into the first coil aperture, and wherein a second coil aperture of the plurality of coil apertures is configured to receive a second coil of the plurality of coils that is inserted into the second coil aperture.

17. The baffle insert of claim 16, wherein the baffle insert is inserted into the firearm suppressor housing.

18. The baffle insert of claim 16, wherein the plurality of coils are inserted into the baffle insert.

19. The baffle insert of claim 18, wherein at least one of the plurality of coils extends less than an entire length of the baffle insert.

20. The baffle insert of claim 18, wherein at least one of the plurality of coils extends an entire length of the baffle insert.

* * * * *